United States Patent [19]

Lohmer

[11] 4,399,214

[45] Aug. 16, 1983

[54] PROCESS FOR HARDENING COLOR PHOTOGRAPHIC SILVER HALIDE EMULSION LAYERS

[75] Inventor: Karl Lohmer, Leverkusen, Fed. Rep. of Germany

[73] Assignee: Agfa-Gevaert Aktiengesellschaft, Leverkusen, Fed. Rep. of Germany

[21] Appl. No.: 199,359

[22] Filed: Oct. 21, 1980

Related U.S. Application Data

[63] Continuation of Ser. No. 971,248, Dec. 20, 1978, abandoned.

[30] Foreign Application Priority Data

Dec. 30, 1977 [DE] Fed. Rep. of Germany ..... 2759100

[51] Int. Cl.[3] ..... G03C 1/74; G03C 1/30; G03C 7/26

[52] U.S. Cl. ..... 430/532; 430/541; 430/543; 430/545; 430/546; 430/621; 430/626; 430/637; 430/638

[58] Field of Search ..... 430/532, 621, 626, 637, 430/638, 541, 543, 545, 546

[56] References Cited

U.S. PATENT DOCUMENTS

| | | |
|---|---|---|
| 3,582,337 | 6/1971 | Griggs et al. . |
| 3,607,345 | 9/1971 | Webster et al. . |
| 3,645,743 | 2/1972 | Mucke et al. . |
| 3,676,144 | 7/1972 | Schulz et al. . |
| 3,676,189 | 7/1972 | Woodward et al. . |
| 3,898,089 | 8/1975 | Yamamoto et al. . |
| 4,007,163 | 2/1977 | Habu et al. . |

FOREIGN PATENT DOCUMENTS

| | | |
|---|---|---|
| 872153 | 3/1953 | Fed. Rep. of Germany . |
| 2354336 | 5/1974 | Fed. Rep. of Germany . |
| 1111930 | 5/1968 | United Kingdom . |

*Primary Examiner*—Charles L. Bowers, Jr.
*Attorney, Agent, or Firm*—Connolly and Hutz

[57] ABSTRACT

In a process for hardening gelatine containing layers of color photographic multi-layered materials which have a paper laminated with a polyolefin layer arranged on both sides a substrate 1,3,5-triacrylohexahydro-1,3,5-triazine and a polyhydric aliphatic alcohol with 3 to 10 carbon atoms are added to the casting solutions and the casting solutions are then applied to a corona irradiated surface of the substrate.

3 Claims, No Drawings

PROCESS FOR HARDENING COLOR PHOTOGRAPHIC SILVER HALIDE EMULSION LAYERS

CROSS REFERENCE

This application is a continuation of the copending U.S. application Ser. No. 971,248, filed Dec. 20, 1978, now abandoned for "Process For Hardening Color Photographic Silver Halide Emulsion Layers" by Karl Lohmer.

This invention relates to a process for hardening gelatin containing layers of color photographic multi-layered materials which have a paper laminated with a polyolefin layer arranged on both sides as substrate layer.

The hardening of protein layers an, in particular, of photographic gelatin layers is known. It considerably increases the resistance of these layers to mechanical damage during processing.

Triacryloformal (1,3,5-triacrylohexahydro-1,3,5-triazine) has been disclosed as hardener for gelatine in German Pat. No. 872,153. This hardener has proved to be particularly suitable for hardening photographic gelatin layers which contain color couplers because, in contrast to many other hardeners, e.g. formalin, it does not react with the dye components and other emulsion additives. One major disadvantage of hardening with triacryloformal is the low velocity of the hardening reaction with gelatin. This can be increased by increasing the quantity of hardener used.

It is also known that the hardening velocity of gelatin layers can be increased by simultaneously using polyhydric alcohols and certain hardeners, including triacryloformal.

It is also known from German Offenlegungsschrift No. 2 354 336 that the hardening activity of compounds such as aldehydes, triazine compounds or compounds containing active vinyl groups as hardeners in gelatin layers of conventional photographic materials can be promoted by means of polyhydric alcohols.

In German Offenlegungsschrift No. 2 359 345 a photographic silver halide material is described whose physical properties are improved by glyoxal, a water soluble salt of 2,4-dichloro-6-hydroxy-5-triazine and a polyhydric alcohol having at least two hydroxyl groups, contained in a silver halide emulsion layer or in an auxiliary layer.

Lastly, it is known from British Pat. No. 1,111,930 to improve the physical and photographic properties of photographic silver halide emulsion layers containing gelatin by incorporating with them a trihydric alcohol containing three methylol groups attached to a carbon atom, e.g. 1,1,1-trimethylol propane.

When observing the hardening response of gelatin layers it is found that the velocity of hardening generally depends upon the pH and the relative humidity to which the gelatin layer is exposed during storage. High relative humidities (above 60% r.h.) have a pronounced accelerating effect on the hardening reaction. However, photographic layers cannot be handled at such moistures because the gelatin layer become tacky and the sensitometric properties of the silver halide emulsion layers are deleteriously affected, particularly with regard to their sensitivity.

Polyolefin laminated papers have recently become very important as substrates for photographic reflection viewing materials. The substrate layers nowadays used for color photographic papers are almost exclusively polyolefin laminated papers, because of the advantages which they provide in processing.

When polyolefin laminated paper is used as layer substrate the dependence of the speed of hardening of silver halide emulsion layers containing triacryloformal as hardener upon the moisture content of the layer is particularly important. At a given partial pressure of water vapour, the inside cellulose paper contains about nine times the quantity of water as the silver halide emulsion layer. Since the polyolefin layer situated between the photographic gelatin layer and the cellulose felt is permeable to water vapour, the equilibrium moisture content of the inner paper determines the relative moisture of the gelatin layer during storage. As already mentioned above, the speed of hardening depends upon the moisture content at equilibrium, so that if a paper substrate which is coated with polyolefin on both sides (PE substrate) is in equilibrium with 40% r.h. at 23° C., it is necessary to use a larger quantity of triacryloformal as hardener, based on the quantity of gelatin, than in the case of a PE substrate in which the inner paper is at equilibrium with 60% r.h. in order to obtain approximately the same speed of hardening.

It is difficult to maintain uniform moisture content in the inner paper in an industrial manufacturing process and certain fluctuations over the length and breadth of the web are inevitable. When the layers are applied to such webs of paper, the quantity of hardener can only be adjusted to an average moisture content, and those areas of the layers on the web which differ from this average value will also differ in their degree of complete hardening. Those parts of the coated web in which the inner paper has a higher moisture content also have greater hadening, and conversely. The sensitometric values, particularly the sensitivity and gradation of that layer of a color photographic material which contains yellow coupler, are found to be distinctly dependent upon the degree of hardening, and any differences in hardening cause fluctuations in these sensitometric values.

This invention is thus based on the problem of eleminating the fluctuations in the degree of hardness caused by variations in the water content of the inner paper of a paper substrate coated with polyolefin on both sides which is used for color photographic recording materials.

The invention relates to a process for hardening light sensitive silver halide gelatin emulsion layers which contain color components and light insensitive auxiliary gelatin layers of a color photographic multi-layered material which contains, as substrate layer, a paper which is laminated with a layer of polyolefin on both sides, characterised in that from 0.4 to 0.8% by weight, based on gelatin, of 1,3,5-triacrylohexahydro-1,3,5-triazine are added as hardener and 2 to 20 times this quantity by weight of a polyhydric aliphatic alcohol with from 3 to 10 carbon atoms, based on the quantity of hardener, are added to the casting solutions of the layers, and the casting solutions are then applied to a corona irradiated surface of the substrate layer.

The process according to the invention makes it possible to prevent the sensitometric variations in gradation and sensitivity caused by variations in hardening in color photographic papers on PE substrates in which the inner paper has equilibrium moistures of 30 to 60% r.h.

It is surprisingly found that, under the conditions of the process according to the invention, the quantity of triacryloformal can be kept constant independent of the moisture content of the inner paper. This constancy of moisture is an important precondition for eliminating sensitometric fluctuations. Sufficient hardening speeds are obtained independently of the moisture level of the inner paper in spite of the relatively small quantities of triacryloformal. Excellent results are obtained if the polyhydric alcohol is used in approximately 2 to 20 times the quantity by weight of hardener.

Examples of polyhydric alcohols suitable for the process of the invention include glycerol, 1,1,1-trimethylol ethane, 1,1,1-trimethylol propane, 1,1,1-trimethylol isobutane and 1,1,1-trimethylol hexane; glycerol and trimethylol propane are preferred.

The order in which the components are added to the layers of a multi-layered color photographic material is of no importance. The polyhydric alcohol may be distributed uniformly among the various casting solutions of all the layers of a multi-layered material or the total quantity of alcohol appropriate for the total quantity of hardener may be added to a single casting solution, for example to the last one. The polyhydric alcohol is obviously capable of accelerating the hardening reaction between triacryloformal and gelatin and thereby eliminating the dependence of the hardening speed on the water content of the gelatin layer.

The quantities of triacryloformal used for hardening color photographic silver halide gelatin emulsion layers are generally from 0.4 to 0.8% by weight, based on the weight of gelatin in the casting solution, and this applies also to the process of this invention.

The inner paper of the substrate layer covered with polyolefin is a conventional paper of this type used in the photographic industry, which is suitably sized so that it does not affect the adherence of the polyolefin layers and is capable of withstanding the treatments to which a photographic paper is subjected. The paper must from the start have sufficient strength and dimensional stability and have a calendered surface.

The polyolefins used for coating the two sides of the raw paper used as inner paper are preferably polypropylene, polyethylene or mixtures of these two polymers, extruded on both sides of the raw paper in known manner.

The surface of the polyolefin film which is to be coated with the silver halide emulsion layers is rendered hydrophilic by a known corona discharge treatment process in order to improve the adherence of the aqueous emulsion layers. The treatment may be carried out at a voltage of about 72,000 to 200,000 volt and a speed of transport of the web of from 50 to 75 m/min. 450 kHz may be used as guide line for the frequency.

The color photographic multi-layered materials may contain the usual color couplers generally incorporated in silver halide layers. The red sensitive layer, for example, contains a non-diffusible color coupler for producing the cyan partial image, generally a coupler based on phenol or α-naphthol. The green sensitive layer contains at least one non-diffusible color coupler for producing the magenta partial color image, usually a color coupler based on 5-pyrazolone or indazolone. The blue sensitive layer unit contains at least one non-diffusible color coupler for producing the yellow partial image, generally a color coupler having an open chain ketomethylene group. Numerous color couplers of this type are known and have been described in a large number of patent specifications and other publications, for example the publication entitled "Farbkuppler" by W. PELZ in "Mitteilungen aus den Forschungslaboratorien der Agfa, Leverkusen/München", Volume III (1961), and K. VENKATARAMAN in "The Chemistry of Synthetic Dyes", Volume 4, 341 to 387, Academic Press, 1971. So-called 2-equivalent or 4-equivalent couplers or white couplers may, of course, be used as non-diffusible color couplers.

The layers of the photographic materials may also contain the usual additives for such layers, e.g. natural or synthetic binders and chemical or optical sensitizers, as described e.g. in Belgian Pat. Nos. 493,464; 568,687 and 547,323, in the article by R. KOSLOWSKY in Z.Wiss.Phot. 46, 65–72 (1951), in Belgian Pat. No. 537,278, British Pat. No. 727,982 or in the work by F. M. HAMER "The Cyanine Dyes and related Compounds", 1964. The layers may also contain the usual stabilizers.

The color photographic multi-layered materials which can be prepared by the process according to the invention may be processed mechanically. This means that the gelatin layer has reached such a degree of mechanical strength by cross-linking that neither the mechanical stresses to which it is subjected by transport over rollers nor the bath temperatures above 30° C. cause any damage to the layers in the material.

The layer melting points given in the examples which follow were determined by the following procedure: A sample is dipped in water at room temperature and pH 5. The temperature of the water is then raised at the rate of 1° per minute until it reaches boiling point. The melting point is defined by the water temperature at which the gelatin layer becomes detached. In samples which reach boiling point, the boiling time required to detach the layers is determined.

Percentages given in the examples are percentages by weight unless otherwise indicated.

EXAMPLE 1

Arrangements of layers A 1

The following layers were applied to a substrate layer consisting of a corona irradiated polyethylene laminated paper in which the inner paper (170 g/m$^2$) is in equilibrium with 60% relative humidity at 23° C. and each polyethylene layer is 35μ in thickness:

1. A red sensitized silver chlorobromide gelatin emulsion at pH 6.5 containing a cyan coupler and, per kg of casting solution, 0.1 mol of silver halide, 8 g of coupler, 54 g of gelatin and 0.35 g of triacryloformal was cast to form a layer weighing 40 g per m$^2$ when wet, and was then dried.

The cyan coupler used corresponds to the following formula:

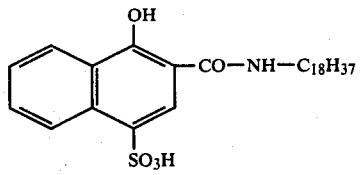

2. Over this layer was arranged a gelatine separation layer containing 35 g of a 3% aqueous gelatin solution (pH 6.5) which contained 0.21 g of triacryloformal per liter, and this layer was dried.

3. A green sensitized silver chlorobromide gelatin emulsion containing a magenta coupler was then applied in the same quantity as layer 1 and dried. The magenta coupler corresponds to the following formula:

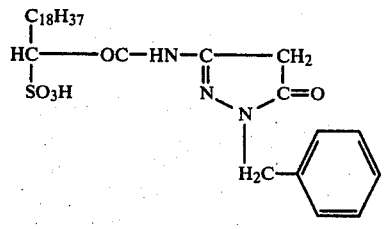

4. A layer identical to that described under 2. was then cast.
5. On the aforesaid layer was applied a silver bromide emulsion which contained a yellow coupler and which was sensitive to blue light. The same quantitative proportions were observed as under 1. The yellow coupler corresponds to the following formula:

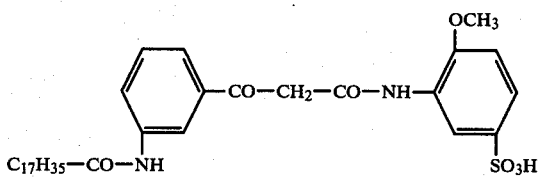

6. The uppermost layer applied was again the same as layer 2.

At the end of the drying process, the cast layers were kept at 60% relative humidity and 23° C. for 4 minutes and then packed under moisture-tight conditions.

Arrangement of layers B 1

An arrangement of layers similar to that of A 1 was prepared on polyethylene coated paper in which the inner paper was in equilibrium with 50% r.h. at 23° C.

Arrangement of layers C 1

An arrangement of layers similar to that of A 1 was prepared on polyethylene coated paper in which the inner paper was in equilibrium with 35% r.h. at 23° C.

Arrangement of layers D 1

An arrangement of layers similar to that of A 1 was prepared on a cellulose acetate foil filled with $TiO_2$ pigment.

Arrangement of layers E 1

An arrangement of layers similar to that of A 1 was prepared on a polyethylene terephthalate substrate pigmented with $TiO_2$.

Samples were cut out of layers A 1 to E 1, packed under light proof and moisture conditons at room temperature and the state of hardening was determined at regular intervals after casting by determining the temperature of the water at which the gelatin layers dissolved off. The results are summarized in the following table:

| Storage time (days) | 0 | 10 | 20 | 30 | 40 | 50 | 60 | 70 |
|---|---|---|---|---|---|---|---|---|
| Melting points A 1 | 32° | 44° | 95° | fast | = | = | = | = |

-continued

| Storage time (days) | 0 | 10 | 20 | 30 | 40 | 50 | 60 | 70 |
|---|---|---|---|---|---|---|---|---|
| | | | | to boiling | | | | |
| Melting points B 1 | 32° | 32° | 35° | 38° | 42° | 48° | 61° | 93° |
| Melting points C 1 | 31° | 32° | 33° | 35° | 36° | 38° | 40° | 45° |
| Melting points D 1 | 32° | 42° | 88° | 98° | fast to boiling | = | = | = |
| Melting points E 1 | 32° | 43° | 91° | fast to boiling | = | = | = | = |

Whereas samples A 1, D 1 and E 1 show the desired increase in hardening and are sufficiently hard to be processed mechanically at a development temperature of 35° C. from the 30th day onwards, the hardening of sample B 1 and C 1 is insufficient and the samples cannot be used for mechanical processing even after 70 days.

EXAMPLE 2

In another series A 2 to E 2, an arrangement of layers similar to those described in Example 1 were applied to the same substrates as used for A 1 to E 1 but in this case 0.95% of triacryloformal as hardener was added, based on the quantity of gelatin.

The results of hardening are summarized in the following table.

| Storage time (days) | 0 | 10 | 20 | 30 | 40 | 50 | 60 | 70 |
|---|---|---|---|---|---|---|---|---|
| Melting point A 2 | 32° | fast to boiling | = | = | = | = | = | = |
| Melting point B 2 | 33° | 42° | 88° | fast to boiling | = | = | = | = |
| Melting point C 2 | 32° | 35° | 37° | 40° | 42° | 49° | 63° | 91° |
| Melting point D 2 | 33° | 98° | fast to boiling | = | = | = | = | = |
| Melting point E 2 | 32° | fast to boiling | | | | | | |

Due to the larger quantity of hardener, sample B 2 now reached the necessary mechanical strength for machine processing without the sensitometric values being deleteriously affected. Samples A 2, D 2 and E 2 hardened excessively. After 70 days storage under these conditions, swelling in the developer was insufficient and the sensitivity, e.g. of the blue sensitive layer, was reduced by 0.2 log It units and there was a loss in gradation by 25%. Sample C 2 was still unsuitable for machine processing.

EXAMPLE 3

In a third series, A 3 to E 3, the same substrates as used for A 1 to E 1 were covered with the same layers but the quantity of triacryloformal, based on the quantity of gelatin, was increased to 1.25%.

The results of hardening are shown in the following table.

| Storage time (days) | 0 | 10 | 20 | 30 | 40 | 50 | 60 | 70 |
|---|---|---|---|---|---|---|---|---|
| Melting points A 3 | 33° | fast to | = | = | = | = | = | = |

-continued

| Storage time (days) | 0 | 10 | 20 | 30 | 40 | 50 | 60 | 70 |
|---|---|---|---|---|---|---|---|---|
| Melting points B 3 | 33° | boiling 85° | fast to boiling | = | = | = | = | = |
| Melting points C 3 | 33° | 42° | 83° | 98° | fast to boiling | = | = | = |
| Melting points D 3 | 32° | fast to boiling | = | = | = | = | = | = |
| Melting points E 3 | 33° | fast to boiling | = | = | = | = | = | = |

In this case, the material of sample C 3 reached the necessary mechanical strength for machine processing at elevated temperatures after 40 days. The swelling values of samples A 3, D 3 and E 3 treated with these quantities of hardener were so low that the blue sensitivity was lower by 0.3 log It units than in the case of A 1, D 1 and E 1 and the gradation was 40% below the nominal value.

The results show that color papers in which the paper substrate is made water tight on both sides with polyolefin layers which are permeable to water vapour give unsatisfactory mechanical and sensitometric results when hardened with triacryloformal due to variations in moisture which are unavoidable for technical reasons.

EXAMPLE 4

An arrangement of layers A 4 to E 4 was prepared using the substrates and casting solutions of A 1 to E 1. Glycerol was added to all of the casting solutions in 5 times the quantity of hardener. The melting points obtained on the samples after storage are summarized in the following table.

| Storage time (days) | 0 | 10 | 20 | 30 | 40 | 50 | 60 | 70 |
|---|---|---|---|---|---|---|---|---|
| Melting point A 4 | 33° | fast to boiling | = | = | = | = | = | = |
| Melting point B 4 | 32° | 96° | fast to boiling | = | = | = | = | = |
| Melting point C 4 | 33° | 95° | fast to boiling | = | = | = | = | = |
| Melting point D 4 | 32° | 98° | fast to boiling | = | = | = | = | = |
| Melting point E 4 | 33° | fast to boiling | = | = | = | = | = | = |

The differences in hardening between the PE substrates A 1, B 1 and C 1 recorded in the series A 1 to E 1 have virtually disappeared and the melting points rise more rapidly.

All of the samples reach the necessary mechanical strength for machine processing. The sensitometric values of all of the samples are also uniform both in sensitivity and gradation and in the corresponding nominal values.

EXAMPLE 5

The casting solutions described in Example 1 were cast on the substrates A 1 to E 1 but trimethylol propane was added to each casting solution in 7 times the quantity of hardener. The melting points of the samples are summarized in the following table.

| Storage time (days) | 0 | 10 | 20 | 30 | 40 | 50 | 60 | 70 |
|---|---|---|---|---|---|---|---|---|
| Melting point A 5 | 33° | fast to boiling | = | = | = | = | = | = |
| Melting point B 5 | 33° | fast to boiling | = | = | = | = | = | = |
| Melting point C 5 | 32° | 96° | fast to boiling | = | = | = | = | = |
| Melting point D 5 | 32° | fast to boiling | = | = | = | = | = | = |
| Melting point E 5 | 33° | fast to boiling | = | = | = | = | = | = |

In this series again all of the samples reach the mechanical strength necessary for machine processing together with the correct nominal values of the sensitometric properties with equally small quantities of hardener, independently of the moisture level of the inner paper of the PE substrates.

I claim:

1. In a process for hardening gelatin for color photographic material which comprises; corona irradiating the surface of a substrate layer support comprised of a cellulose paper which is laminated with a layer of polyolefin on both sides to form an inner paper, said inner paper having an equilibrium moisture of 30–60% relative humidity, casting at least one gelatin-containing color component silver halide emulsion layer associated with a supported gelatin layer on said support, the improvement of adding to a casting solution for at least one layer for application, a solution consisting essentially of gelatin, a hardening solution of 0.4 to 0.8% by weight, based on gelatin, of 1,3,5-triacrylohexahydro-1,3,5-triazine and a polyhydric aliphatic alcohol with from 3 to 10 carbon atoms in an amount of 2 to 20 times the quantity of the hardener by weight on said support.

2. A process as claimed in claim 1, in which the polyhydric alcohol is glycerol or 1,1,1-trimethylol propane.

3. A process as claimed in claim 1 in which the layer of polyolefin is polypropylene, polyethylene or a mixture thereof.

* * * * *